US006007692A

United States Patent [19]

Herbert et al.

[11] Patent Number: 6,007,692

[45] Date of Patent: Dec. 28, 1999

[54] ELECTROFORMING MANDRELS WITH CONTOURED SURFACES

[75] Inventors: William G. Herbert, Williamson; Loren E. Hendrix, Webster; Gary J. Maier, Webster; Ernest F. Matyi, Webster, all of N.Y.

[73] Assignee: Xerox Corporation, Stamford, Conn.

[21] Appl. No.: 08/043,953

[22] Filed: Apr. 5, 1993

[51] Int. Cl.[6] ..... C25D 1/02

[52] U.S. Cl. ..... 205/70; 204/279

[58] Field of Search ..... 204/279; 205/70

[56] References Cited

U.S. PATENT DOCUMENTS

| | | | |
|---|---|---|---|
| 4,307,928 | 12/1981 | Petlock, Jr. | 339/254 M |
| 4,501,646 | 2/1985 | Herbert | 204/4 |
| 4,549,939 | 10/1985 | Kenworthy et al. | 204/4 |
| 4,711,833 | 12/1987 | McAneney et al. | 430/131 |
| 4,781,799 | 11/1988 | Herbert, Jr. et al. | 204/9 |
| 4,902,386 | 2/1990 | Herbert et al. | 204/9 |
| 4,906,951 | 3/1990 | Moeller | 333/21 A |
| 4,909,582 | 3/1990 | Haidle et al. | 350/96.1 |
| 5,021,109 | 6/1991 | Petropoulas et al. | 156/137 |
| 5,064,509 | 11/1991 | Melnyk et al. | 204/9 |

*Primary Examiner*—Arun S. Phasge
*Attorney, Agent, or Firm*—Zosan S. Soong

[57] ABSTRACT

A mandrel comprising a surface effective for electroforming an article thereon, wherein a portion of the mandrel has a contoured surface effective for facilitating axial movement away from the mandrel of the article formed thereon when the article experiences circumferential motion relative to the mandrel.

9 Claims, 4 Drawing Sheets

ELECTROFORMING MANDRELS WITH CONTOURED SURFACES

This invention relates generally to electroforming mandrels and more particularly to mandrels having a contoured surface to facilitate the separation of the electroformed article from the mandrel. The electroformed article may be used for example as a substrate in the fabrication of photoreceptors or layered photoconductive imaging members.

To facilitate separation, there are conventionally selected materials for the electroformed article and the mandrel with different thermal coefficients of expansion. After the electroformed article is deposited on the mandrel, the composite structure is then cooled or heated, wherein the electroformed article contracts or expands at a different rate or to a different extent from the mandrel, thereby effecting a parting gap. There is a need for new methods and equipment for facilitating separation, including those which do not need to rely on a difference in thermal coefficients of expansion between the electroformed article and the mandrel. These methods and apparatus would be advantageous since the same or similar material could be used for the mandrel and the electroformed article. Such methods and apparatus may be useful with materials such as nickel on stainless steel which create a negative parting gap, i.e., where the electroform shrinks to a greater extent and/or more rapidly than the mandrel.

The following documents may be of interest:

Herbert et al., U.S. Pat. No. 4,902,386, discloses a mandrel having an ellipsoid shaped end.

Herbert, U.S. Pat. No. 4,501,646, discloses an electroforming process which effects a parting gap by heating or cooling.

Petropoulous et al., U.S. Pat. No. 5,021,109, discloses devices and methods to facilitate removal of a tubular sleeve from a mandrel, reference for example, col. 11.

Melnyk et al., U.S. Pat. No. 5,064,509, discloses devices and methods to facilitate removal of an electroformed article from a mandrel, reference, cols. 12–13.

McAneney et al., U.S. Pat. No. 4,711,833, discloses air assisted removal of substrates from a mandrel, reference for example, col. 10, lines 30–40.

Kenworthy et al., U.S. Pat. No. 4,549,939, discloses the removal of an electroformed part from a photomask mandrel by a variety of ways, reference, for example, col. 3.

Herbert et al., U.S. Pat. No. 4,781,799, discloses an elongated electroforming mandrel, the mandrel comprising at least a first segment having at least one mating end and a second segment having at least one mating end, the mating end of the first segment being adapted to mate with the mating end of the second segment.

SUMMARY OF THE INVENTION

It is an object of the present invention to facilitate separation of the mandrel and the article formed thereon by providing a mandrel with a contoured surface.

It is a further object in embodiments to select materials for the mandrel and the electroformed article having similar or different coefficients of expansion.

It is an additional object in embodiments to provide a method and apparatus for facilitating separation of the mandrel and electroform when the materials of the mandrel and electroform create a negative parting gap.

It is another object in embodiments to effect separation of the mandrel and an article formed thereon by causing the circumferential motion of the mandrel or the article to simultaneously have a motion component in the direction of separation, i.e., in the axial direction.

These objects and others are accomplished in embodiments by providing a mandrel comprising a portion having a contoured surface effective for facilitating movement, especially axial movement, away from the mandrel of an article formed thereon when the article is subjected to circumferential motion relative to the mandrel.

BRIEF DESCRIPTION OF THE DRAWINGS

Other aspects of the present invention will become apparent as the following description proceeds and upon reference to the Figures, which represent preferred embodiments.

DETAILED DESCRIPTION

In FIGS. 1–4, there is provided a mandrel comprising an end portion having tapered sides which converge to form the bottom of the mandrel, wherein a portion of the mandrel has a contoured surface effective for facilitating axial movement away from the mandrel of an article formed thereon when the article experiences circumferential motion relative to the mandrel. The phrase end portion defines a reference region for the location of the mandrel contoured surface. Since an electroforming mandrel is typically an integral one-piece device, it is sometimes difficult to precisely define where the mandrel sides end and where the end portion begins, particularly if the mandrel possesses tapered sides. For convenience, the phrase end portion generally refers to that portion of the mandrel wherein the overlying electroformed material can be discarded without adversely affecting the desired final electroformed article. Typically, an article electroformed on a mandrel of the present invention will exhibit an inner contoured surface corresponding to the contoured surface of the mandrel. The contoured inner surface of the article will be akin to a "mirror image" of the mandrel's contoured surface. For example, when the mandrel's contoured surface comprises an external screw thread, the article's inner contoured surface will be a corresponding internal screw thread. An electroformed article having such a contoured region may be undesirable for some purposes, such as a photoreceptor substrate. The contoured surface can be removed by any appropriate method, such as by cutting off the length of the electroformed article containing the contoured surface. The phrase end portion can have other meanings, depending on the circumstances. For example, when no part of the electroform article is discarded, the phrase end portion could identify the tapered portion of the mandrel. When the mandrel has tapered sides or when the mandrel has flat ends like a barrel, the phrase end portion could specify in embodiments an arbitrarily defined length of the mandrel such as from about ⅛ to about ⅓ of the mandrel length as measured from the mandrel bottom. In embodiments, the end portion comprises a length, as measured from the mandrel bottom, of from about 0.5 cm to about 50 cm, and especially from about 1 cm to about 15 cm.

Figure 1:
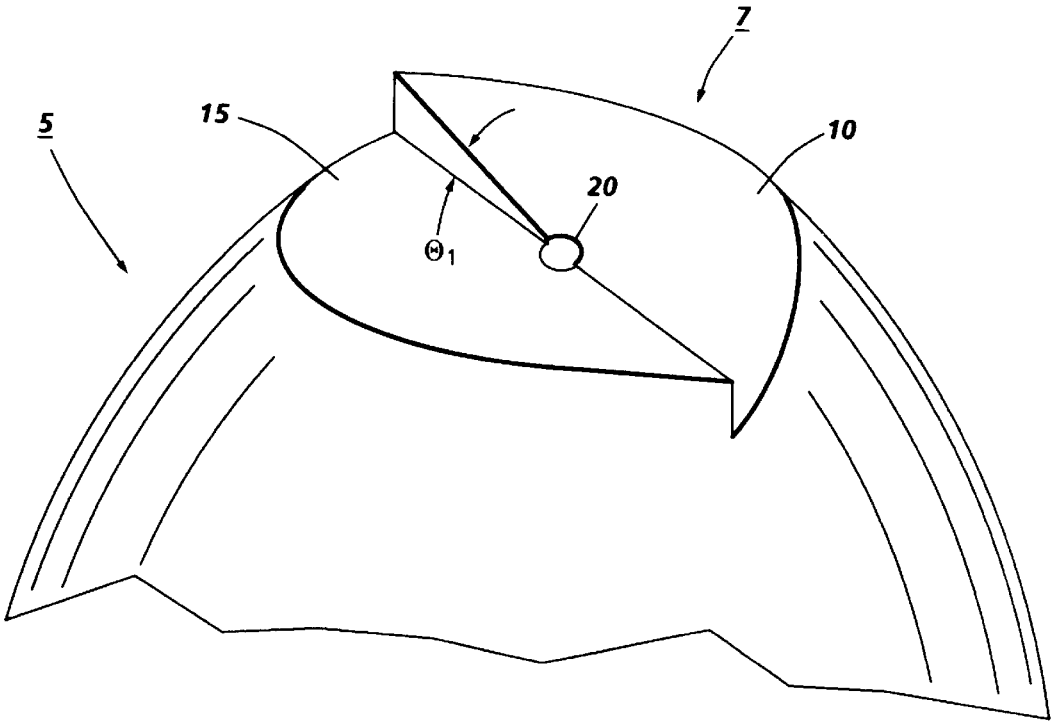
FIG. 1 is a schematic illustration of a mandrel having a contoured surface comprising two opposed planes located at the mandrel bottom.

In FIG. 1, at the bottom of mandrel 5, contoured region 7 comprises two opposed planes, first plane 10 and second plane 15, wherein one or both planes may be inclined in any effective manner to facilitate the separation of the electroform from the mandrel. It is understood that where only one plane is inclined, the other plane is level, i.e., horizontal. An effective angle exists between the two planes regardless of whether one plane is inclined while the other plane is level, or both are inclined. Angle $\Theta_1$ preferably ranges from about 5 to about 70°, and more preferably from about 10 to about 40°. First plane 10 and second plane 15 may be of any effective dimensions and may be the same or different dimensions. For example, each plane may be in the shape of a semicircle, preferably having a radius ranging from about 0.1 to about 6 inches, and more preferably from about 0.5 to about 3 inches. The two planes cover an effective area of the mandrel bottom, and preferably ranging from about ⅓ to the entire mandrel bottom. In embodiments, the contoured region of FIG. 1 covers a circular shaped area having a radius ranging from about 0.1 to about 6 inches, and more preferably from about 0.5 to about 3 inches.

Figure 2:
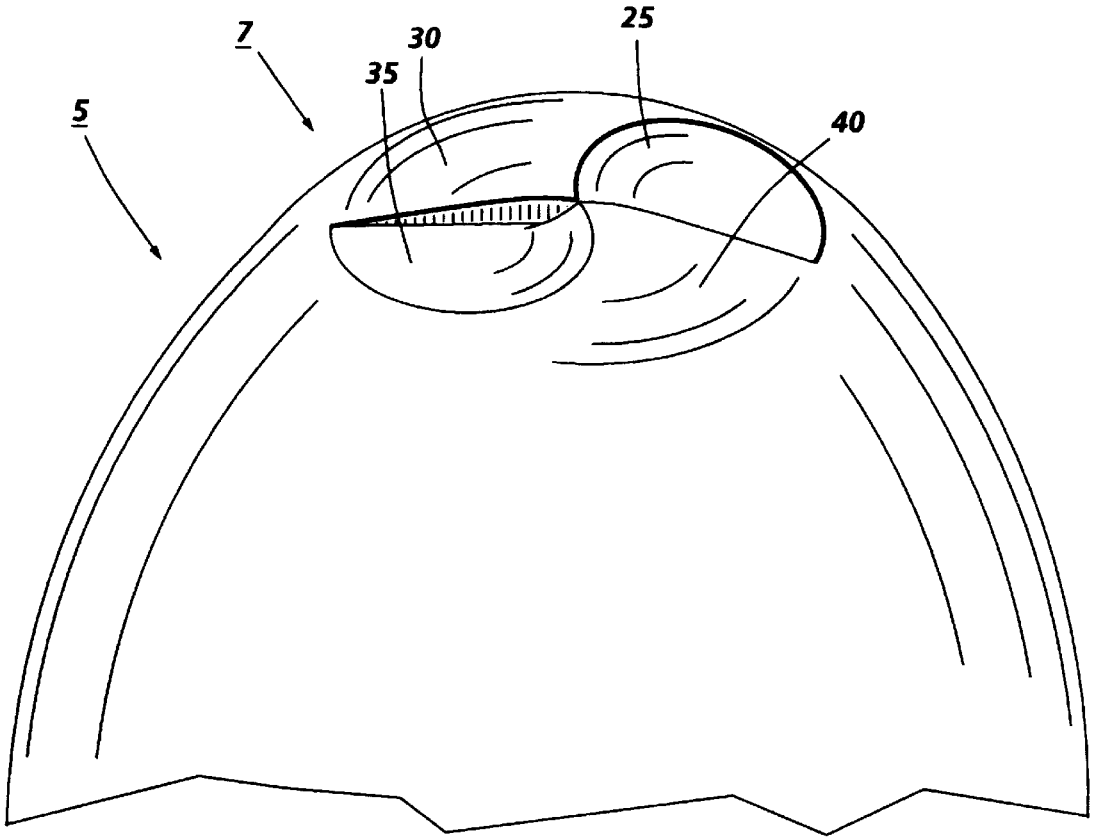
FIG. 2 is a schematic illustration of a mandrel having a contoured surface located at the mandrel bottom, wherein the contoured surface has a design similar to that of the head of a one-way screw.

In FIG. 2, at the bottom of mandrel 5, contoured region 7 comprises first flat region 25 curving into first raised region 30 and a second flat region 35 curving into a second raised region 40, wherein first flat region 25 is opposite to second raised region 40, and second flat region 35 is opposite to first raised region 30. Raised areas 30 and 40 and flat regions 25 and 35 may be of any effective suitable shape and dimensions and may have the same or different shape and dimensions. Preferably, raised areas 30 and 40 resemble hills with gently sloping sides, with a maximum height ranging for example from about 0.1 mm to about 1 cm, and particularly from about 0.5 mm to about 5 mm. The contoured region of FIG. 2 covers an effective area of the mandrel bottom, and preferably ranges from about ⅓ to the entire mandrel bottom. In embodiments, the contoured region of FIG. 2 covers a circular shaped area having a radius ranging from about 1 to about 6 inches, and more preferably from about 0.5 to about 3 inches. In embodiments of FIG. 2, contoured region 7 may resemble the head of a suitable one-way screw except it is preferred that the slot for the screwdriver is absent. One-way screws are well known and it is believed that the head designs of these screws may be adapted for use in embodiments of the present invention.

Figure 3:
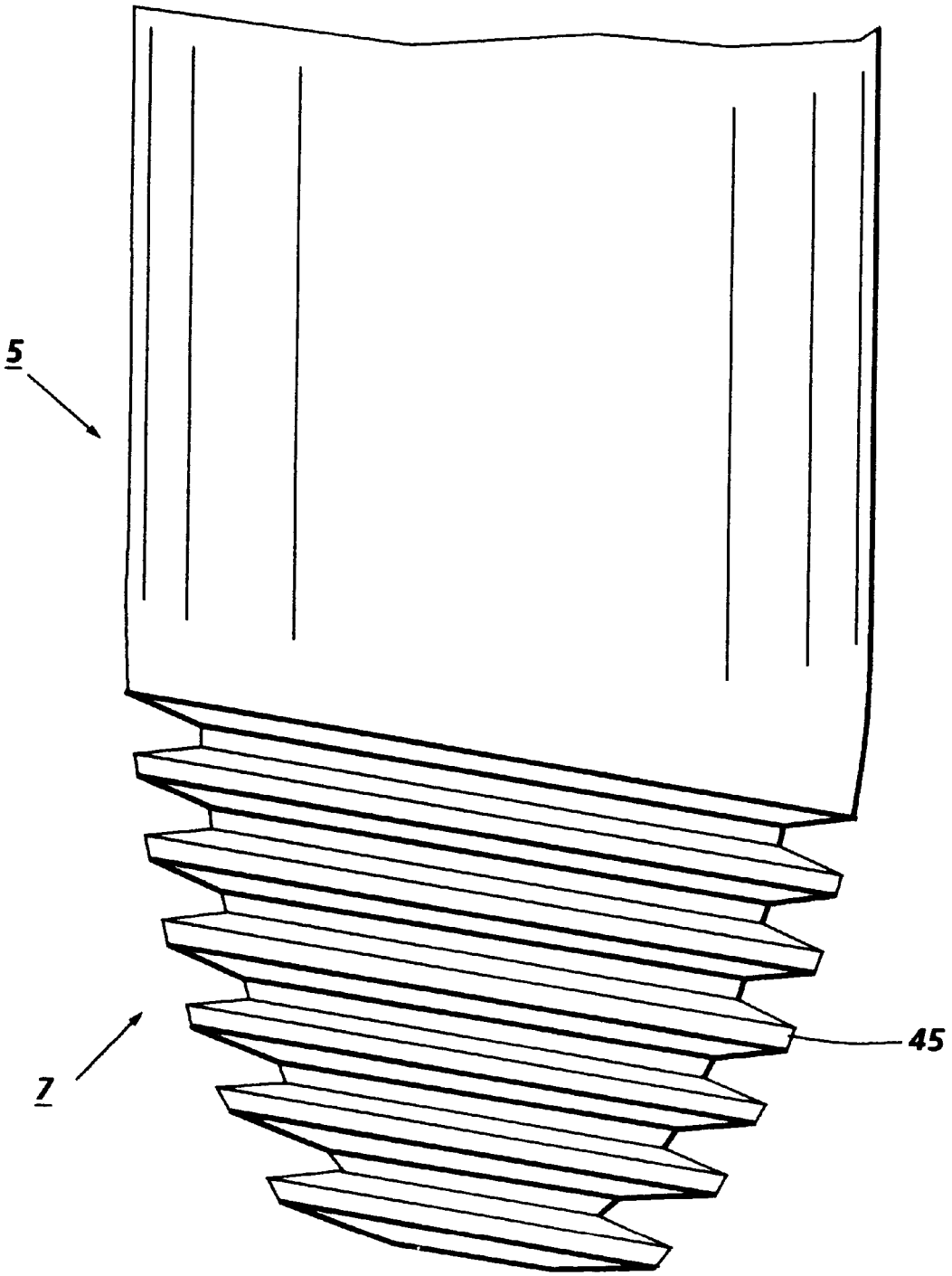
FIG. 3 is a schematic illustration of a mandrel having a threaded end portion.

In FIG. 3, on the end portion of mandrel 5, contoured region 7 comprises external screw thread 45 which is a helical ridge that extends around the mandrel circumference and along at least a portion of the length of the end portion. Screw thread 45 extends along an effective length of the mandrel, preferably from about ⅓ to the entire length of the end portion. In embodiments, screw thread 45 can extend beyond the end portion to a portion of the length of the mandrel sides such as from about 1 mm to about 5 cm of the mandrel length beyond the end portion. Screw threads are known, reference Giesecke et al., *Technical Drawing*, pp. 354–393 (4th Ed. 1958), the disclosure of which is totally incorporated by reference. In embodiments, multiple threads may also be employed, i.e., two or more helical ridges running side by side. Screw thread 45 has an effective depth, preferably from about 0.5 mm to about 1 cm, and especially from about 1 mm to about 5 mm in depth. Screw thread 45 has an effective thread pitch, preferably from about 0.5 mm to about 1 cm, and more preferably from about 1 mm to about 3 mm. The term pitch refers to the distance, measured in the axial direction, between two corresponding points on adjacent threads. Both right-hand and left-hand threads may be used. Any effective screw thread form may be employed including Sharp-V, American National, Unified, Square, Acme, Whitworth Standard, Worm, Knuckle, and Buttress. The screw thread angle may be of any effective configuration, and preferably from about 20° to about 70°.

Figure 4:
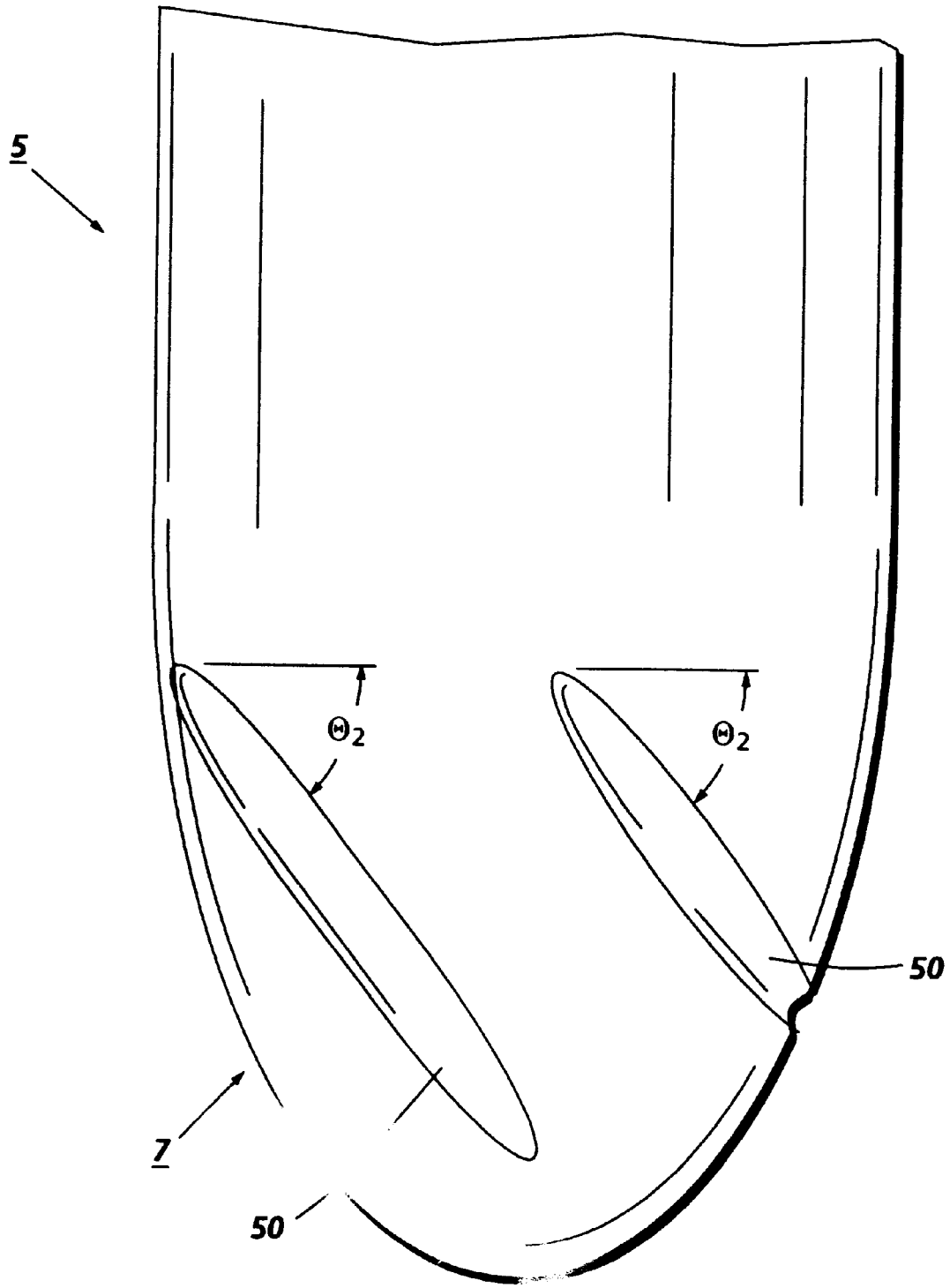
FIG. 4 is a schematic illustration of a mandrel having a plurality of grooves located on the mandrel end portion.

In FIG. 4, on the end portion of mandrel 5, contoured region 7 comprises one or more grooves 50 which may have the same or different shape, size, and alignment relative to one another. Grooves 50 comprise an effective number such as a plurality like two, three, four, or more. Grooves 50 may be of any effective shape, size, and alignment relative to one another and in embodiments exhibit the following: extend around a portion of the mandrel circumference, preferably from about ¼ to about ¾ of the mandrel circumference; preferably have a length ranging from about 2 mm to about 10 cm, and more preferably about 4 mm to about 5 cm; an angle $\Theta_2$ ranging from about 5 to about 70°, and more preferably from about 10 to about 40°; extend along an effective length of the mandrel, preferably from about ⅓ to the entire length of the end portion; an effective depth such as from about 0.5 mm to about 1 cm, and especially from about 1 mm to about 5 mm in depth; preferably have a width from about 1 mm to about 5 cm, and especially from about 3 mm to about 1 cm; an effective cross-sectional shape, including those groove shapes found in screw threads such as Sharp-V, Knuckle, and Square, and the like. In embodiments, grooves 50 can extend beyond the end portion to a portion of the length of the mandrel sides such as from about 1 mm to about 5 cm of the mandrel length beyond the end portion.

The contoured surfaces of the mandrels in FIGS. 1–4 may be formed by any suitable technique including metal shaping processes. For instance, screw threads and grooves may be formed by an appropriate cutting tool.

Material is deposited on the mandrel to form an article thereon. The deposited material may cover or coat in a continuous or semicontinuous manner, in embodiments, the mandrel surface including the contoured surface. The mandrel or the article is provided a circumferential motion, i.e., rotated, by any appropriate method and apparatus including manual rotation or rotation effected by a motor. It is believed that the contoured surface of the mandrel in contact with the article's contoured surface causes the circumferential motion to have a simultaneous component in the direction of separation. Additional axial force may also be applied to the article or the mandrel to effect separation such as from 5 to about 100 Newtons. In embodiments, the mandrel and the article have a parabolic shaped end portion. Separation may be effected by manually holding the parabolic shaped end portion of the article, rotating the article while keeping the mandrel immobile, and applying additional axial force in the direction of separation to accomplish parting of the article from the mandrel. In embodiments, the parabolic shaped end of the article containing the corresponding contoured surface is cut off.

In embodiments, before circumferential motion is provided to the mandrel or the article, an effective parting gap may be created therebetween along the entire length of the mandrel or a portion thereof to facilitate separation. Preferably, the parting gap ranges from about 0.1 mm to about 1 cm, and more preferably from about 0.1 mm to about 5 mm in width separating the electroform and the mandrel. The parting gap may be created by any suitable method including reliance on differences in the coefficients of thermal expansion between the mandrel and the article. Processes to create a parting gap are illustrated in Bailey et al., U.S. Pat. No. 3,844,906 and Herbert, U.S. Pat. No. 4,501,646, the disclosures of which are totally incorporated by reference.

The mandrel may have any effective design, and may be hollow or solid. The mandrel may have any effective cross-sectional shape such as cylindrical, oval, square, rectangular, or triangular. Preferably, the mandrel has an oval cross-sectional shape. In embodiments, the mandrel may have tapered sides. A preferred mandrel has an ellipsoid shaped end, with the mandrel profile preferably like that illustrated in Herbert et al., U.S. Pat. No. 4,902,386, the disclosure of which is totally incorporated by reference. It is understood that the top end of the mandrel may be open or closed, flat or of any other suitable design. The mandrel may be of any suitable dimensions. For example, the mandrel may have a length ranging from about 5 cm to about 100 cm; and an outside diameter ranging from about 0.5 cm to about 50 cm. The mandrel may be fabricated from any suitable material, preferably a metal such as aluminum, nickel, steel, iron, copper, stainless steel, and the like.

An optional hole or slight depression at the end of the mandrel is desirable to function as a bleeding hole to facilitate more rapid removal of the electroformed article from the mandrel. The bleed hole prevents the deposition of metal at the apex of the tapered end of the mandrel during the electroforming process so that ambient air may enter the space between the mandrel and the electroformed article during removal of the article subsequent to electroforming. The bleed hole should have sufficient depth and circumference to prevent hole blocking deposition of metal during electroforming. For a small diameter mandrel having an outside diameter between about 1/16 inch (0.2 mm) and about 2.5 inches (63.5 mm) a typical dimension for bleed hole depth ranges from about 3 mm to about 14 mm and a typical dimension for circumference ranges from about 5 mm and about 15 mm. Other mandrel diameters such as those greater than about 63.5 mm may also utilize suitable bleed holes having dimensions within and outside these depth and circumference ranges.

The mandrel may be optionally plated with a protective coating. The plated coating is generally continuous except for areas that are masked or to be masked and may be of any suitable material. Typical plated protective coatings for mandrels include chromium, nickel, alloys of nickel, iron, and the like. The plated metal should preferably be harder than the metal used to form the electroform and is of an effective thickness of for example at least 0.001 mm in thickness, and preferably from about 0.008 to about 0.05 mm in thickness. The outer surface of the plated mandrel preferably is passive, i.e., abhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electrodeposited metal such as nickel. However, other suitable metal surfaces could be used for the mandrels. The mandrel may be plated using any suitable electrodeposition process. Processes for plating a mandrel are known and described in a number of patents. For example, a process for applying multiple metal platings to an aluminum mandrel is described in U.S. Pat. Nos. 4,067,782, and 4,902,386, the disclosures of which are totally incorporated by reference.

Articles may be formed on the plated mandrels of this invention by any suitable process, preferably electroforming. Processes for electroforming articles on the mandrel are also well known and described, for example, in U.S. Pat. Nos. 4,501,646 and 3,844,906, the disclosures of which are totally incorporated by reference. The electroforming process of this invention may be conducted in any suitable electroforming device. For example, a plated cylindrically shaped mandrel having an ellipsoid shaped end may be suspended vertically in an electroplating tank. The electrically conductive mandrel plating material should be compatible with the metal plating solution. For example, the mandrel plating may be chromium. The top edge of the mandrel may be masked off with a suitable non-conductive material, such as wax to prevent deposition. The electroplating tank is filled with a plating solution and the temperature of the plating solution is maintained at the desired temperature such as from about 50 to about 65° C. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current such as from about 50 to about 900 amperes per square foot can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank.

Any suitable method and apparatus may be employed to assist in the removal of the electroformed article from the mandrel. For example, a mechanical parabolic end parting fixture may be employed to grasp the preferably parabolic shaped end of the electroform. The grasping jaws may have as few as three fingers or may completely contact the electroform circumference like a lathe collet. Alternatively, a vacuum cup may be placed under the preferably parabolic shaped end of the mandrel. A vacuum would be generated by the use of air pressure or vacuum pump. In another approach, the electroform/mandrel composite structure is inserted into an induction coil and by energizing the coil the electroform is heated and consequently enlarges, thereby loosening it from the mandrel. In a different approach, vibrational energy, especially ultrasonic energy, is used to cause the electroform to separate from the mandrel. In one embodiment, an ultrasonic bath is used during or after the parting gap is established to assist in removal of the electroform. It is also possible to use a vibrator which contacts the electroform or the mandrel.

Other modifications of the present invention may occur to those skilled in the art based upon a reading of the present disclosure and these modifications are intended to be included within the scope of the present invention.

We claim:

1. A process comprising:

(a) forming an article on a mandrel comprised of a contoured surface, wherein the article overlays the contoured surface of the mandrel, thereby resulting in the article comprised of a corresponding contoured surface, wherein the contoured surface of the mandrel defines:

(i) two opposed planes, at least one of which is inclined;

(ii) a first flat region curving into a first raised region and a second flat region curving into a second raised region;

(iii) a screw thread; or (iv) one or more grooves; and (b) subjecting the article to circumferential motion relative to the mandrel, wherein moving the corresponding contoured surface of the article over the contoured surface of the mandrel self-generates axial movement of the article away from the mandrel.

2. The process of claim 1 wherein (a) is accomplished by electroforming the article on the mandrel.

3. The process of claim 1, wherein the mandrel comprises an end portion and the contoured surface is located on the end portion.

4. The process of claim 1, further comprising (c) removing the corresponding contoured surface of the article.

5. The process of claim 1, wherein (b) is accomplished by rotating the article while keeping the mandrel immobile.

6. A process comprising:

(a) forming an article on a mandrel comprised of a contoured surface, wherein the article overlays the contoured surface of the mandrel, thereby resulting in the article comprised of a corresponding contoured surface, wherein the contoured surface of the mandrel defines: (i) two opposed planes, at least one of which is inclined; and (b) subjecting the article to circumferential motion relative to the mandrel, wherein moving the corresponding contoured surface of the article over the contoured surface of the mandrel self-generates axial movement of the article away from the mandrel.

7. A process comprising:

(a) forming an article on a mandrel comprised of a contoured surface, wherein the article overlays the contoured surface of the mandrel, thereby resulting in the article comprised of a corresponding contoured surface, wherein the contoured surface of the mandrel defines: (ii) a first flat region curving into a first raised region and a second flat region curving into a second raised region; and (b) subjecting the article to circumferential motion relative to the mandrel, wherein moving the corresponding contoured surface of the article over the contoured surface of the mandrel self-generates axial movement of the article away from the mandrel.

8. A process comprising:

(a) forming an article on a mandrel comprised of a contoured surface, wherein the article overlays the contoured surface of the mandrel, thereby resulting in the article comprised of a corresponding contoured surface, wherein the contoured surface of the mandrel defines: (iii) a screw thread; and (b) subjecting the article to circumferential motion relative to the mandrel, wherein moving the corresponding contoured surface of the article over the contoured surface of the mandrel self-generates axial movement of the article away from the mandrel.

9. A process comprising:

(a) forming an article on a mandrel comprised of a contoured surface, wherein the article overlays the contoured surface of the mandrel, thereby resulting in the article comprised of a corresponding contoured surface, wherein the contoured surface of the mandrel defines: (iv) one or more grooves; and (b) subjecting the article to circumferential motion relative to the mandrel, wherein moving the corresponding contoured surface of the article over the contoured surface of the mandrel self-generates axial movement of the article away from the mandrel.

* * * * *